United States Patent [19]

Hammersla, Jr.

[11] Patent Number: 4,856,837

[45] Date of Patent: Aug. 15, 1989

[54] REINFORCED CARGO SLING AND METHOD

[75] Inventor: Robert L. Hammersla, Jr., Greenville, S.C.

[73] Assignee: Woven Electronics Corporation, Mauldin, S.C.

[21] Appl. No.: 156,528

[22] Filed: Feb. 16, 1988

[51] Int. Cl.[4] ..... B66C 1/12

[52] U.S. Cl. ..... 294/74; 139/411

[58] Field of Search ..... 294/740; 139/411, 409, 139/408, 410, 412, 413, 415, 420 R; 428/245, 246, 252, 255, 257, 258, 259

[56] References Cited

U.S. PATENT DOCUMENTS 4,200,325 4/1980 Johnson ..... 294/74

4,209,044 6/1980 Taki ..... 294/74

*Primary Examiner*—James B. Marbert

*Attorney, Agent, or Firm*—Cort Flint

[57] ABSTRACT

A woven webbing sling (A) for hoisting industrial cargo is disclosed which includes woven outer plies (28,29) which include woven warp yarns (22,24 and 30,32) interwoven with a weft yarn (26). Plies of filler material (35) extend between the outer plies. Protective edges (18,20) include vinyl coated yarns (B) having elongation properties generally equal to that of the woven warp yarns to resist cutting of the sling.

10 Claims, 2 Drawing Sheets

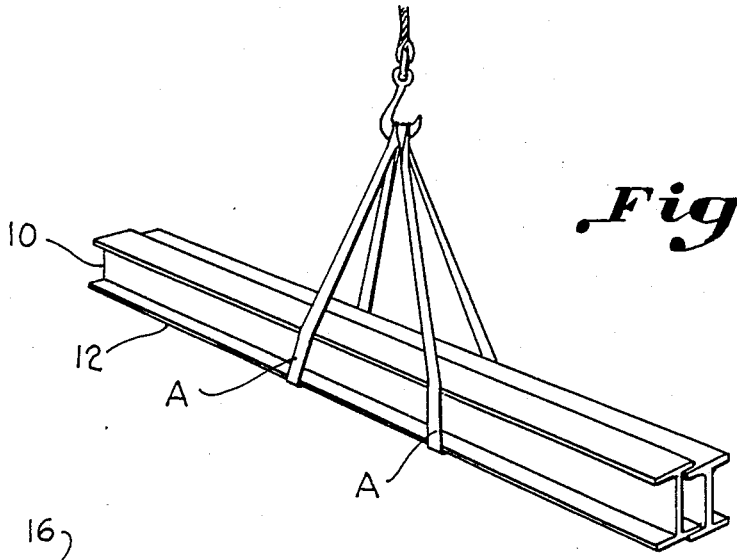
Fig. 1.
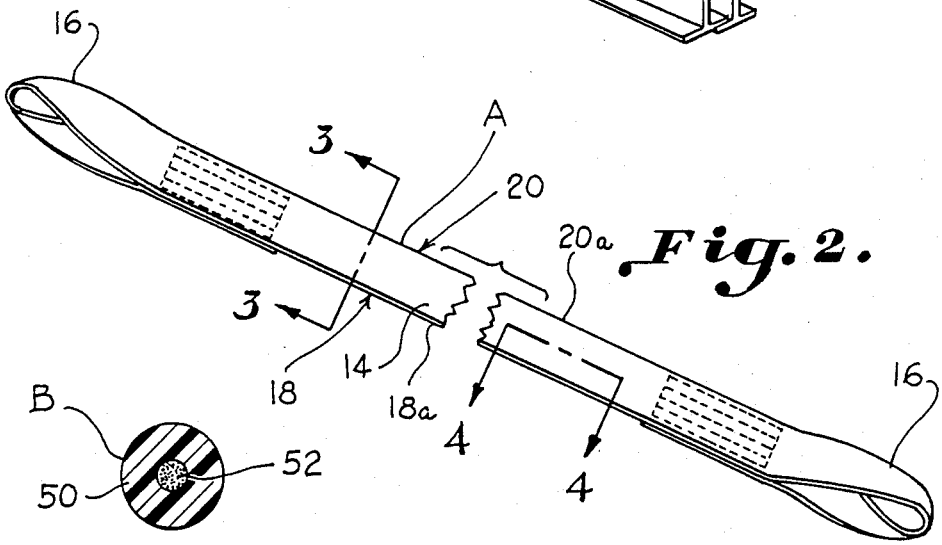
Fig. 2.
Fig. 7.
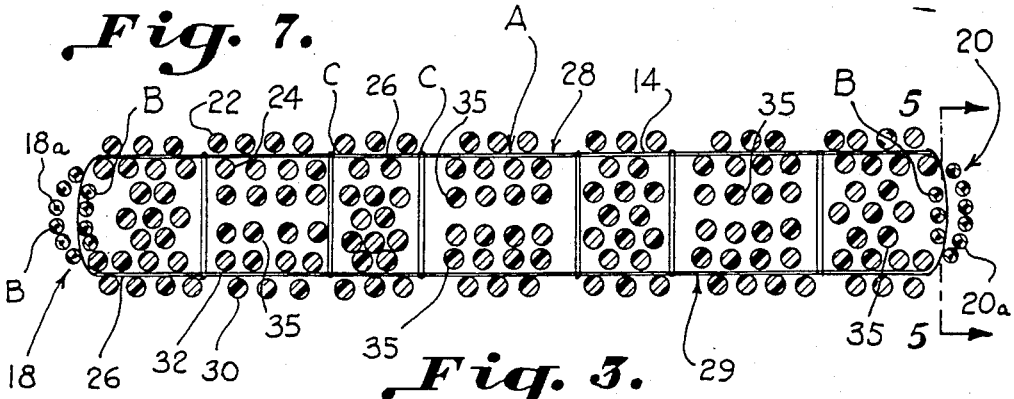
Fig. 3.

REINFORCED CARGO SLING AND METHOD

BACKGROUND OF THE INVENTION

The invention relates to industrial cargo webbing slings used with hoist equipment to lift cargo and articles.

Braided wire, chains, miscellaneous cables, and webbing slings have been utilized with industrial hoist equipment. The present invention relates to webbing slings which have become increasingly popular. Typically, webbing slings are made from lengths of woven webbing having multiple plies. The slings are made in different strength grades depending upon the construction. The webbing is woven from suitable synthetic yarns like nylon or polyester. The webbing is fabricated into a sling for the purpose of hoisting, lifting and general material handling. Webbing with soft eyes is shown in U.S. Pat. Nos. 2,903,291, 3,592,502, 3,776,585, and 4,025,100. Typical weave patterns are shown in the patents for webbing. The problems of abrading and cutting of the selvage edge occur with webbing slings. Most of the load is concentrated at the selvage edge of the webbing. For example, in lifting railroad cargo such as large I-beams, the edges of the webbing encounter the sharp edges of the metal I-beams. When the edge is cut, the webbing sling must be taken out of service. Often the material portion of the webbing is still strong and in tact.

In the past, webbing slings have been treated with different substances such as latex for increased abrasion resistance. Also, web pads which fit over the webbing sling have been provided to reduce abrasion or cutting of the edges. The web pads typically include a length of chrome leather, or webbing folded over the edges of the sling to afford protection to both sides of both edges. Sling life may be prolonged by treating the webbing or using web pads. However, latex treatment offers limited abrasion resistance. Web pads may easily become moved along the length of the sling so that they are no longer in a protective position. Once the cargo or load is lifted, it is not possible to relocate the webbing. In other cases, the operator is careless or not interested in positioning the protective pad carefully. In either case, abrasion protection is lost and the sling may wear out prematurely.

U.S. Pat. No. 4,025,100 discloses weaving carpet type polypropylene yarns in the outer plies of the sling to exhibit higher abrasion resistance and provide a wear surface on each side of the sling. However, the edges contain no additional protection. The edges still wear faster than the planar side surfaces. U.S. Pat. No. 4,052,095 discloses a web sling woven from plastic strands having a laminate of elastomeric material or cured onto the load contacting surface of the sling. The elastomeric material may become embedded in the open mesh of the weave causing the portions of the webbing covered by the material to lose some of its softness and flexibility.

Accordingly, an important object of the present invention is to provide an industrial cargo sling of the webbing type having edges which effectively resist abrasion and cutting.

Another object of the invention is to provide an industrial cargo sling of the webbing type having its edges reinforced against abrasion and cutting without loss of flexibility.

Another object of the invention is to provide a webbing sling having its edges reinforced along their entire length while exhibiting uniform elongation properties at each section of the webbing.

Another object of the present invention is to provide an industrial cargo sling of the webbing type having its edges reinforced against abrasion and cutting continuously along the entire length of the sling so that abrasion resistance may be reliably provided at any load point along the length of its edge.

SUMMARY OF THE INVENTION

The above objectives are accomplished according to the invention by constructing a woven cargo sling by the steps of weaving a first outer ply of said sling by weaving a first plurality of warp yarns in an undulating pattern with a weft yarn. A second outer ply of the sling is woven by weaving a second plurality of warp yarns in an undulating pattern with the weft yarn. A protective edge is woven over an outer periphery of first and second opposing longitudinal edges of the sling extending continuously along the length of the first and second longitudinal edges of the sling. Included in the edge means are protective warp yarns encapsulated with an abrasion resistant coating. The protective warp yarns are woven from the first plurality of warp yarns in the first ply about the first edge of the sling and terminated at the second plurality of warp yarns in the second ply. The protective warp yarns are woven about the second edges from the first plurality of warp yarns in the first ply to the second plurality of warp yarns in the second ply. The protective warp yarns are selected to have elongation properties generally equal to the elongation properties of a first and second plurality of warp yarns so that the protective yarns do not elongate and break.

DESCRIPTION OF THE DRAWINGS

The construction and design to carry out the invention will now be described, together with other features. The invention will be more readily understood from a reading of the following specification and by referring to the accompanying drawings forming a part of the specification which shows an example of the invention and where:

FIG. 1 is a perspective view illustrating a typical sling application of an industrial cargo sling constructed in accordance with the present invention;

FIG. 2 is a perspective view of a reinforced cargo sling constructed in accordance with the present invention;

FIG. 3 is a sectional view taken along line 3—3 of FIG. 2;

FIG. 7 is a sectional view of a reinforcement stand for a reinforced cargo sling in accordance with the invention.

DESCRIPTION OF A PREFERRED EMBODIMENT

Figure 4:
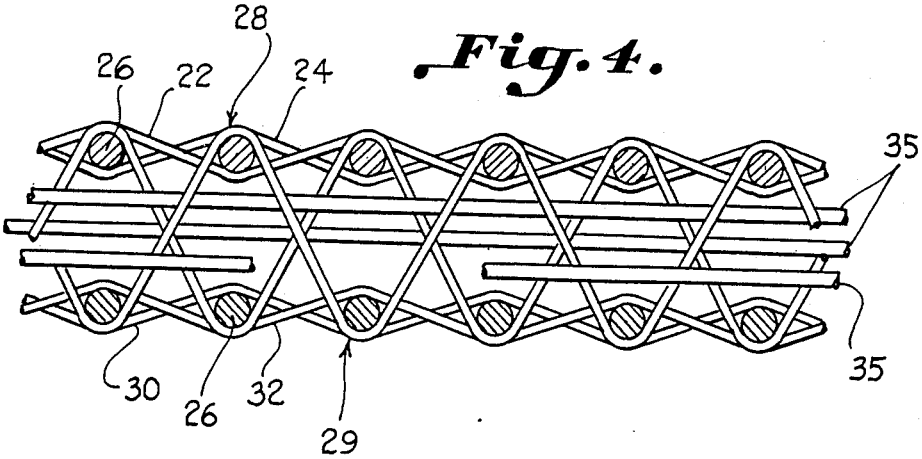
FIG. 4 is a sectional view taken along line 4—4 of FIG. 2.
Figure 5:
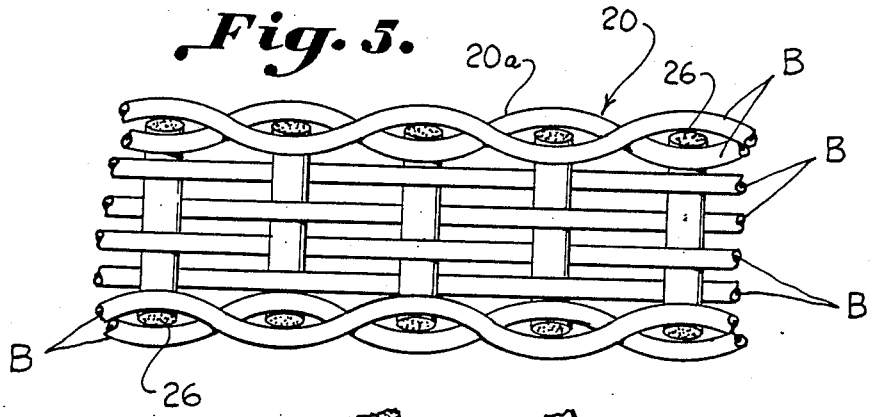
FIG. 5 is an enlarged view of one edge of a reinforced cargo sling constructed in accordance with the present invention.

Referring now in more detail to the drawings, FIG. 1 illustrates a typical sling application in which a pair of cargo webbing slings A are illustrated constructed in accordance with the present invention. Slings A are wrapped about I-beams 10 having flanges 12 which readily cut into the edges of typical slings and offer one of the most severe type applications.

Referring now in more detail to the invention, FIG. 2 illustrates cargo sling A which includes woven webbing 14 with a twisted soft eye 16 at each end of the webbing. In accordance with the invention, reinforced edge means, designated generally as 18 and 20, extend continuously along the opposing edges 18*a* and 20*a* of sling A affording protection against abrading or cutting at any point. The protective edge means 18 and 20 advantageously constitute vinyl coated yarns B woven entirely about and along the edges 18*a* and 20*a* of the webbing. Webbing 14 may be woven in a plain weave pattern with adjacent warp yarns 22 and 24 woven alternately up and down 180 degrees out of phase with a weft yarn 26 is a first outer ply 28. A second outer ply 29 of woven webbing 14 is woven in a similar manner with a second warp system of adjacently woven warp yarns 30 and 32 woven 180 degrees out of phase with weft yarn 26. Warp binders C are woven between the outer plies 28,29 in an undulating pattern, 180 degrees out of phase. Plies of nonwoven gut material 35 extend in the warp direction between outer plies 22, 29 and is bound by the plies 28,29 and warp binders woven between the plies.

Referring now in more detail to protective edge means 28 and 20, as can best be seen in FIGS. 3 and 4, vinyl coated yarns B are also woven in a plain weave pattern at edges 18*a* and 20*a* in an undulating pattern 180 degrees out of phase. Vinyl coated yarns begin at a point 34 on first outer ply 29 and continue around the edge of protective edge means 18 to an opposing point 36 on second outer ply 28. Protective edge means 18 covers approximately 180 degrees of the outer circumference of sling A at edge 18*a* from point 34 to point 36. Protective edge 20 cover a like area of the outer surface of sling A at edge 20*a*.

Figure 6:
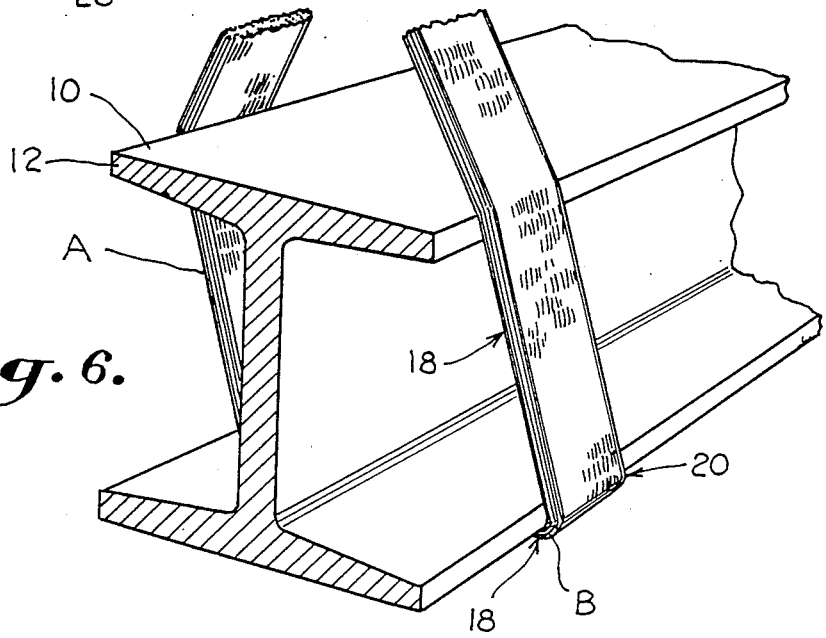
FIG. 6 is an enlarged perspective view of an I-beam held by reinforced webbing sling according to the invention.

As can best be seen in FIG. 6, edges 18 and 20 engage a sharp edge of flange 12 with the reinforced edge yarns B penetrated by the flange instead of the regular warp yarns 22, 24 or 30, 32. The sling has retained its flexibility and the vinyl coated yarns B cut into the edge of the flange with increased abrasion resistance continuously along the length of the webbing. The vinyl coated yarns are tough pliable making the sling highly flexible at the edges so it may wrap effectively about any article or cargo being lifted.

As can best be seen in FIG. 7, vinyl coated yarn B includes a vinyl coating 50 surrounding a polyester cord 52. While the coating 50 may be any suitable polymeric material or abrasion resisting material, has been found that vinyl coated strands are most advantageous and preferred. One suitable vinyl coated yarn is manufactured by Engineered Yarns, Inc. of Coventry, Rhode Island, under the name Arlyn. This vinyl coated yarn has been used mainly in lawn furniture and other outdoor applications. The yarns are known for their flame retardance, fungus resistance, and superior weather resistance, but have not been known or used for abrasion resistant reinforcing yarns. As an abrasion resisting element in an industrial cargo sling of the webbing type, the vinyl coated yarns have been found to provide highly advantageous results. The yarn may be easily woven on conventional looms along with the polyester or nylon yarns being woven in the warp and weft directions in the webbing. Most importantly, the vinyl coated yarns have been found to exhibit generally the same elongation properties as the other warp yarns in the webbing. For example, if polyester is used in the webbing, then vinyl coated polyester will have generally the same elongation properties so that webbing stretch is accommodated uniformly. In the case of typically known reinforcing yarns like Kevlar, for example, the reinforcing yarns have lower elongation factors. This causes the typical reinforcing yarns to absorb the load exclusively and break prematurely. If nylon is used in the webbing, then vinyl coated nylon may be woven in the protective edge.

While a preferred embodiment of the invention has been described using specific terms, the description is for illustrative purposes only. It is to be understood that changes and variations may be made without departing from the spirit or scope of the following claims.

What is claimed is:

1. A method of protecting the edges of a cargo webbing sling against abrasion and cutting continuously along its length while retaining flexibility for handling cargo, said webbing being formed from warp and weft yarns woven together, comprising:

including protective abrasion resistant warp yarns woven continuously along opposing first and second side edges of said webbing sling having a higher resistance to abrasion than a remainder of said warp yarns in said webbing to prevent cutting of the side edges of said webbing sling and resulting sling failure.

2. The method of claim 1 wherein said webbing sling includes warp yarns extending in a warp direction in said webbing sling and the method comprises including protective warp yarns having elongation properties generally equal to the elongation properties of said warp yarns.

3. The method of claim 1 including selecting said protective warp yarns to include synthetic yarns surrounded with an outer vinyl coating and strength offering sufficient pliability for weaving, strength for abrasion resistance, and flexibility for use in a sling.

4. A method of constructing a woven cargo sling comprising:

weaving a first outer ply of said sling by weaving a first plurality of warp yarns in an undulating pattern with a left yarn;

weaving a second outer ply of said sling by weaving a second plurality of warp yarns in an undulating pattern with the weft yarn; and weaving protective edge means over an outer periphery of first and second opposing longitudinal edges extending continuously along the length of said first and second longitudinal edges of said sling; and including in said edge means protective warp yarns each of which is individually encapsulated with an abrasion resistant coating woven from said first plurality of warp yarns in said first ply about said first edge of said sling terminating at said second plurality of warp yarns in said second ply, and said protective warp yarns woven about said second edges from said first plurality of warp yarns in said first ply to said second plurality of warp yarns in said second ply.

5. The method of claim 4 comprising the inclusion of protective warp yarns having elongation properties generally equal to the elongation properties of said first and second pluralities of warp yarns.

6. The method of claim 4 including weaving binder yarns between said first and second outer plies, and weaving said plurality of warp yarns with adjacent warp yarns woven 180 degrees out of phase.

7. The method of claim 4, wherein said coated warp yarns include vinyl coated warp yarns.

8. A woven cargo sling comprising;

a first outer ply including a first plurality of warp yarns woven with a weft yarn;

a second outer ply including a second plurality of warp yarns woven with a weft yarn;

a first protective edge means formed continuously along a first edge of said sling which includes a plurality of protective coated warp yarns each of which is surounded individually with a protective coating woven laterally from said first plurality of warp yarns continuously about said first edge terminating at said second plurality of warp yarns of said second ply; and a second protective edge means formed continuously along a second edge of said sling which includes a plurality of protective coated warp yarns each of which is surrounded individually with a protective coating woven laterally from said first plurality of warp yarns of said first ply about said second edge and terminating at said second plurality of warp yarns at said second ply.

9. The woven cargo sling of claim 8 wherein said protective coated warp yarns have elongation properties generally equal to that of said plurality of warn yarns.

10. The apparatus of claim 8, wherein said protective coating of warp yarns include vinyl coated polyester yarns.

* * * * *